United States Patent [19]

Popkin

[11] Patent Number: 4,967,657

[45] Date of Patent: Nov. 6, 1990

[54] DAMPENING AND INKING DEVICE FOR A ROTARY PRINTING PRESS

[76] Inventor: Leonard F. Popkin, 84-28, 115 St., Richmond Hill, N.Y. 11418

[21] Appl. No.: 449,138

[22] Filed: Dec. 11, 1989

Related U.S. Application Data

[63] Continuation of Ser. No. 182,474, Apr. 15, 1988, abandoned.

[51] Int. Cl.[5] ..... B41F 7/26; B41F 31/34

[52] U.S. Cl. ..... 101/141; 101/148; 101/352

[58] Field of Search ..... 101/141, 147, 148, 349, 101/350, 351, 352, 363, 247, 208–210; 118/258, 259, 414, 261

[56] References Cited

U.S. PATENT DOCUMENTS

| | | | |
|---|---|---|---|
| 3,039,386 | 6/1962 | Trisler | 101/352 X |
| 3,094,067 | 6/1963 | Williams | 101/218 |
| 3,223,028 | 12/1965 | Brigham | 101/218 |
| 3,688,694 | 9/1972 | Preuss et al. | 101/148 |
| 3,749,011 | 7/1973 | Abendroth et al. | 101/148 |
| 3,911,815 | 10/1975 | Banfer | 101/350 |
| 4,287,827 | 9/1981 | Warner | 101/148 |
| 4,729,307 | 3/1988 | Harrison et al. | 101/148 |

*Primary Examiner*—J. Reed Fisher

*Attorney, Agent, or Firm*—Abelman Frayne Rezac and Schwab

[57] ABSTRACT

A water and ink dispenser for a rotary printing press includes a metering roll that is driven by a gear train directly from the printing cylinder, the gears of the gear train each being rotatable on an axis fixed relatively to the axis of rotation of each other gear, in order to avoid chatter and noise in the gear train, a form roll of the device being adjustable relative to the printing cylinder and metering roll entirely independently of said gear train, whereby scuffing and gear marking in the finished print is eliminated.

5 Claims, 4 Drawing Sheets

DAMPENING AND INKING DEVICE FOR A ROTARY PRINTING PRESS

This application is a continuation, of application Ser. No. 182,474, filed Apr. 15, 1988, now abandoned.

FIELD OF THE INVENTION

This invention relates to a device for use in the dampening and inking of printing plates in a rotary lithographic press. While not limited thereto, the present invention finds particular application in a dampening and inking device to be incorporated into an existing rotary lithographic press as a retro-fit.

BACKGROUND OF THE INVENTION

Rotary lithographic presses are well known in the art, as is the requirement to dampen a printing plate of the press in order to prevent or retard contamination of the resist areas of the printing plate with oil based printing inks used in printing from the plates.

Such plates include a dot matrix of up to 100%, which has been rendered oleophilic and hydrophobic, the remaining areas of the plates being hydrophilic and oleophobic.

Numerous devices have been proposed for effecting the dampening of the hydrophilic areas of the plates in order to resist contamination of those areas by the printing ink employed in the printing process. However, none of these devices has been entirely successful in eliminating "scuffing" of the printing plate, and in the elimination of "gear markings" in the finished print.

The undesired effect of "scuffing" arises when the resiliently compressible form roll is distorted out of round by a compressive force exerted thereon by the relatively incompressible printing cylinder. As the printing cylinder itself is cylindrical, such pressure results in an axial indentation in the form roll, the form roll being formed from a resiliently compressible rubber-like material. This manifests itself as an increase in the peripheral speed of the form roll as related to the peripheral speed of the printing cylinder, and in turn results in scuffing of the printing plate, i.e., a smearing of the ink dots forming the dot matrix in the direction of rotation of the printing cylinder.

The term "gear markings" is one commonly used in the trade, and relates to a smearing of the printing ink applied to the printing plate arising from differences in the peripheral speeds of the printing cylinder and, that of a form roll, and which manifests itself as transverse lines of smearing in the finished print.

While scuffing can be reduced to acceptable limits by backing-off the form roll in order to decrease the pressure imposed thereon and reduce the distortion of the form roll to an out-of-round condition, this, in turn, results directly in play or chatter in the gearing employed to drive the form roll and the pick-up roller from the printing cylinder. Chatter or play in the gearing results in oscillating variations in the peripheral speed of the form roll, and intermittent and cyclical over-speeding of the form roll, or, under-speeding thereof. This is seen by the printing cylinder and its printing plate as a variable scuffing of the printing plate in forward and reverse directions, and, manifests itself as lines of transverse smearing in the printed image.

Loudon U.S. Pat. No. 4,455,938 issued June 26, 1984 is typical of such a construction in its use of a direct gear drive from the printing cylinder to the form roll, and a direct gear drive from the form roll to a metering roller. In order to adjust the pressure at the nip between the form roll and the printing cylinder, the form roll must be adjusted or "backed off" radially of the printing cylinder. Similarly, to adjust the pressure at the nip between the metering roller and the form roll, the metering roller must be adjusted or "backed off" radially of the form roll. Such adjustments either can result in the bottoming of the teeth of the associated drive gears and the feeding of noise and vibrations to the form roll, or, in the alternative, can result in free play and chattering in the gear teeth resulting in overspeeding and underspeeding of the form roll. Both of these conditions can result in "scuffing" and "gear marking" in the finished print.

SUMMARY OF THE INVENTION

It is an object of this invention to significantly reduce the problem of scuffing and the problem of gear marking to the point of elimination, and further, to greatly enhance the efficiency of the form roll in its function of applying an even film of water and ink emulsion in a metered flow to the printing plate.

According to the present invention, the metering roll is driven by an idler gear rotatable about a fixed axis independent of the axis of rotation of the form roll, which in turn is driven by a gear fast with the drive shaft of the printing cylinder, each of the gears being rotatable on an axis parallel to and of fixed distance from each other axis.

In this manner, play or chatter of the gear teeth can be eliminated in its entirety up to the practicability of manufacturing tolerances, the option existing of forming on or more gears of the chain as a spring-loaded axially split gear in order to remove any remaining residual play or chatter in the gear train.

Contrary to prior proposals, the form roll is not driven by the intermediate idler gear, but instead is intentionally freely rotatable relative thereto. This results in the isolation of the form roll from any residual gear chatter in the gear transmission and the isolation of the form roll from noise and vibrations produced in the gear train. In this manner, the production of gear markings in the finished print is eliminated in its entirety.

Further, according to the present invention, the form roll is mounted for omni-directional adjustment of its axis of rotation relative to the fixed axis of the idler gear and in parallelism with and relative to the axis of rotation of the printing cylinder. The adjustment is independent of the fixed axis of the rotation of the idler gear, and, in parallelism with the axis of the metering roll and its associated driven gear.

In this manner, the pressure exerted at the nip between the form roll and the printing cylinder, and that exerted at the nip between the metering roll and the form roll can be accurately controlled without in any way affecting the proper inter-engagement of the teeth of the respective gears of the gears chain.

This in turn permits adjustment of the form roll relative to the printing cylinder and the printing plate carried thereby into a minor frictional interengagement, and one which does not cause axial indentitation of the form roll. As there is no distortion of the form roll to an out of round condition that would cause a disparity between its peripheral speed and the peripheral speed of the printing cylinder, the cause of scuffing of the printing plate due to creeping of the form roll relative to the printing plate is eliminated in its entirety.

Further, the nip between the form roll and the metering roller can be accurately adjusted to produce exactly the required extent of metering without in any way affecting an adjustment of the driving gears. Thus, the drive of the form roll proceeds on the minor frictional engagement of the form roll with the printing cylinder and with the metering roll, as assisted by the frictional hydraulic drag of the water and ink emulsion film passing through the respective nips of the rollers.

The frictional drive to the form roll is thus entirely independent of the mechanical drive from the printing cylinder to the metering roll, thus removing the cause of the scuffing between the form roll and the printing plate.

Various other objects and advantages of the present invention will become apparent from the following description of preferred embodiments of the invention as illustrated in the accompanying drawings.

BRIEF DESCRIPTION OF THE DRAWINGS

The invention will now be described with reference to the accompanying drawings, which illustrate a preferred embodiment thereof, and in which.

DESCRIPTION OF THE PREFERRED EMBODIMENT

Figure 1:
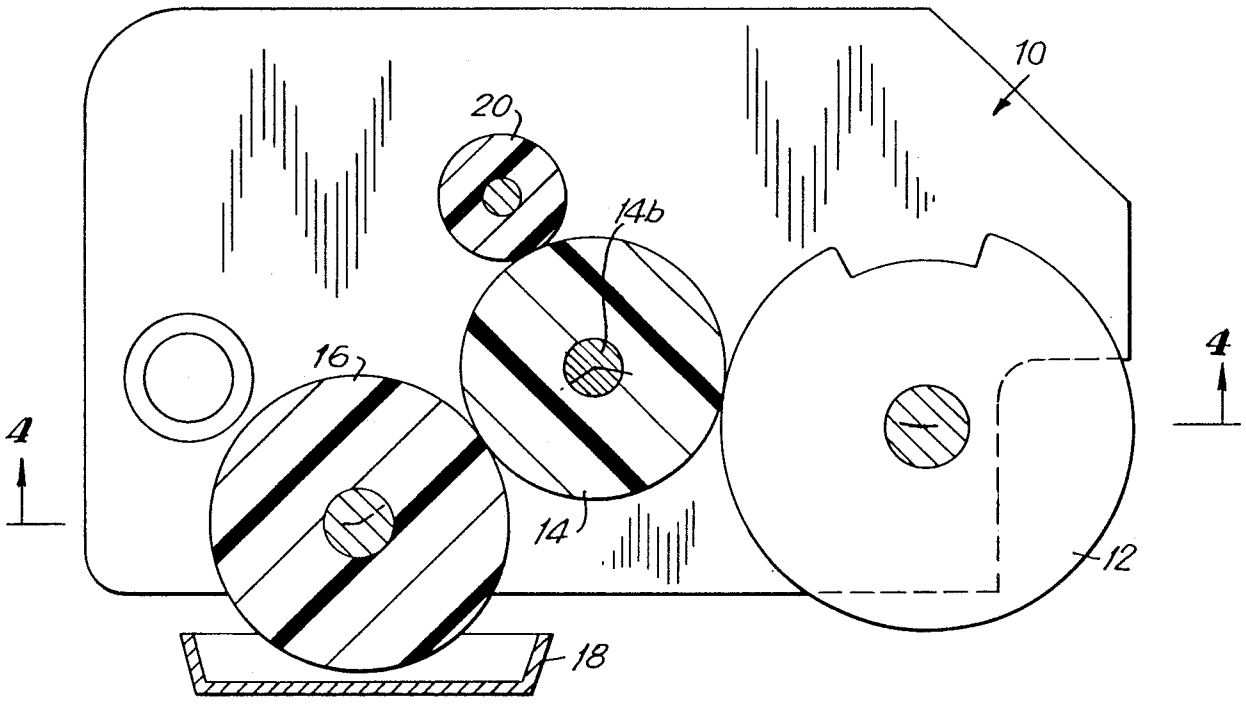
FIG. 1 is a diagrammatic cross-section through the device of the invention in the form of a retro-fit for an existing printing press.

Referring now to FIG. 1, the dampening and inking device of the present invention is comprised by a pair of spaced frame members 10, only one of which s shown in FIG. 1, the frame members 10 being arranged in spaced parallel relation, and secured in any convenient manner against movement relative to each other.

The frame members 10 provides end supports, respectively, for a printing cylinder 12 adapted to carry a printing plate [not shown], a form roll 14 and a metering roll 16.

The metering roll 16, in use of the device, extends into a trough 18 to which a metered quantity of water and printing ink is supplied, as is well known in the art. Alternatively, the metered supply of water and printing ink can be fed to the nip between the form roll 14 and the metering roll 16.

Thus, upon rotation of the printing cylinder 12, the form roll 14 is rotated at a peripheral speed corresponding with the peripheral speed of the printing cylinder 12 and in turn, the metering roll 16 is rotated at a peripheral speed corresponding with the peripheral speed of the form roll 14. Rotation of the metering roll 16 will cause it to pick up on its surface a film of water and printing ink, which is then carried into the nip between the form roll 14 and the metering roll 16. The pressure between the form roll 14 and the metering roll 16 is then adjusted in order that only a metered quantity of water and printing ink can pass through the nip and remain on the surface of the form roll 14 as a metered film of water and printing ink.

To further equalize and distribute the water and ink film on the surface of the form roll 14, optionally, according to the present invention, an axially oscillating form assist roll 20 is provided in pressure contact with the surface of the form roll 14, the assist roll 20 acting to distribute and emulsify the film of water and printing ink on the surface of the form roll 14 during axial oscillation of the form assist roll 20. Any convenient mechanism can be provided for oscillating the form assist roll 20, such mechanisms being well known in the art.

The metered film of water and printing ink in emulsified or partially emulsified form is then carried by the form roll to the nip between the form roll 14 and the printing cylinder 12, at which point the metered film of water and printing ink is deposited on the printing plate carried by the printing cylinder 12.

Printing then proceeds from the printing plate carried by the printing cylinder 12 in an entirely usual manner as well known in the art.

As will be readily apparent, adjustment of the relative positions of the form roll 14 relative to the printing cylinder 12 and the position of the metering roll 16 relative to the form roll 14 now become extremely critical. Specifically, the pressure exerted between metering roll 16 and the form roll 14 must be only sufficient to permit the required metered quantity of water and ink to pass through the nip between those rolls, otherwise, an excessive amount of water and ink would be fed to the printing plate carried by the printing cylinder 12 with disastrous consequences. Further, the pressure between the form roll 14 and the printing cylinder 12 must be adjusted with extreme accuracy, otherwise, an excessive quantity of water and printing ink would be built up at the nip between the printing cylinder 12 and the form roll 14 if the pressure is too great, with consequential under-inking of the printing plate, or, in the event that the pressure between the printing cylinder and the form roll 14 is too low, then, flooding of the printing plate will occur. These considerations are ones which are well known in the art and which are common to most forms of rotary printing.

However, it is at this point that a major problem emerges, that problem now being discussed with reference to the diagrammatic illustration of the prior art mechanism of FIG. 2.

In order to secure rotation of the metering roll 16 in timed relation with the printing cylinder 12, this being one of the essential parameters, some form of drive must be provided between the printing cylinder 12 and the metering roll 16. This is accomplished by providing a spur gear **12*a* which is fixed to and rotatable in unison with the printing cylinder 12, the spur gear 12*a* in turn driving an idler gear 14*a*, which, according to the prior art teachings, is fast with the form roll 14. The idler gear 14*a*, in turn meshes with a driven gear 16*a*, fast with the metering roll 16. Thus, upon rotational movement of the printing cylinder 12, a corresponding rotational movement is produced in both the form roll 14 and the metering roll 16 to maintain their circumferential velocity in correspondence with the circumferential velocity of the printing cylinder 12. Any lack of identity between the peripheral velocities of the printing cylinder 12, the form roll 14 and the metering roll 16 will result in "scuffing" of the printing plate, i.e., will result in the emulsion of water and printing ink carried by the form roll 14** being smeared onto the printing plate, with consequential disastrous effects on the printed image, and wearing of the printing plate.

While the maintenance of identical peripheral speeds is one essential parameter, further parameters are involved, namely, the extent of compression between the printing cylinder 12 and the form roll 14, and the extent of compression between the metering roll 16 and the form roll 14. As these variables cannot be accommodated within manufacturing tolerances of the device, some means must be provided for accommodating these variables.

Figure 2:
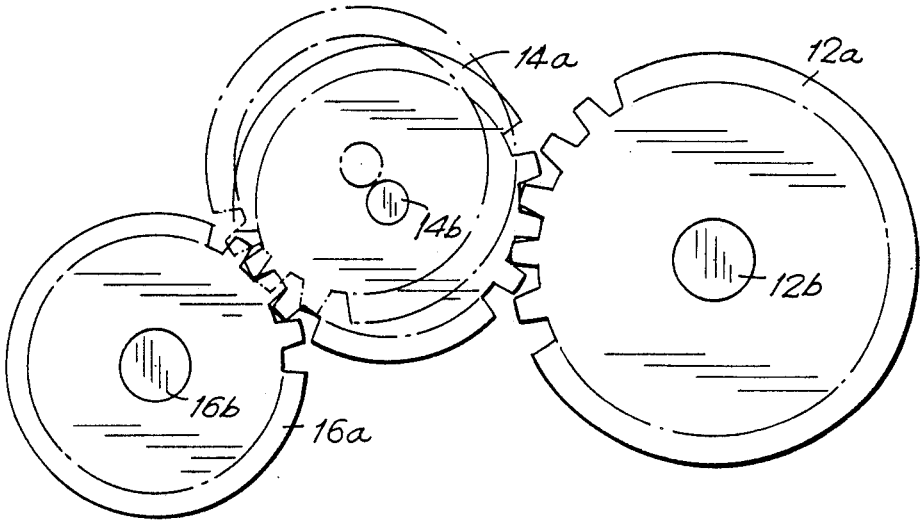
FIG. 2 PRIOR ART
FIG. 2 is a diagrammatic illustration of the gear train of a prior art device such as is disclosed in Loudon U.S. Pat. No. 4,445,938.

According to the prior art, and as illustrated in FIG. 2, in order to provide for adjustment of the pressure between the printing cylinder 12 and the form roll 14, the shaft on which the form roll 14 and its associated idler gear 14*a* are mounted is supported for adjustable movement towards or away from the axis of the shaft 12*b* on which the printing cylinder 12 and its associated drive gear 12*a* are mounted.

However, movement of the shaft 14*b* towards the shaft 12*b* in order to increase the pressure at the nip between the printing cylinder 12 and the form roll 14 will have the effect of causing the teeth of the gears 12*a* and 14*a* to move towards or into bottoming relation with each other and will result in excessive noise and vibration produced in the gearing and which is transmitted to the form roll 14. Movement of the shaft 14*b* away from the shaft 12*b*, to the contrary, will cause the teeth of the gears 12*a* and 14*a* to move out of correct meshing engagment with each other and will result in free play and chatter in the teeth. Free play and chatter in the teeth will have the effect of permitting unrestrained movement of the form roll 14 relative to the printing cylinder 12 both in forward and reverse directions, and will result in gear markings in the finished print. This is due to smearing in the forward circumferential direction of the printing cylinder in the event that the form roll overspeeds or reverse smearing of the printing cylinder in the event that the form roll underspeeds, this manifesting itself in the finished print as transverse lines of smearing in the finished print.

A closely similar condition arises between the metering roll 16 and the form roll 14 in the event that the position of the shaft 14*b* of the form roll 14 is adjusted relative to the shaft 16*b* of the metering roll 16. Again, excessive noise can be produced in the gearing in the event that the gear teeth 14*a* and 16*a* bottom down on each other. In the event that free play exists between the gear teeth 14*a* and 16*a*, then chatter can occur between the gear teeth 14*a* and 16*a*, and the respective rolls can move within the extent of the free play in the gear teeth, with consequential disturbances in the film of water and printing ink metered onto the surface of the form roll 14.

Figure 3:
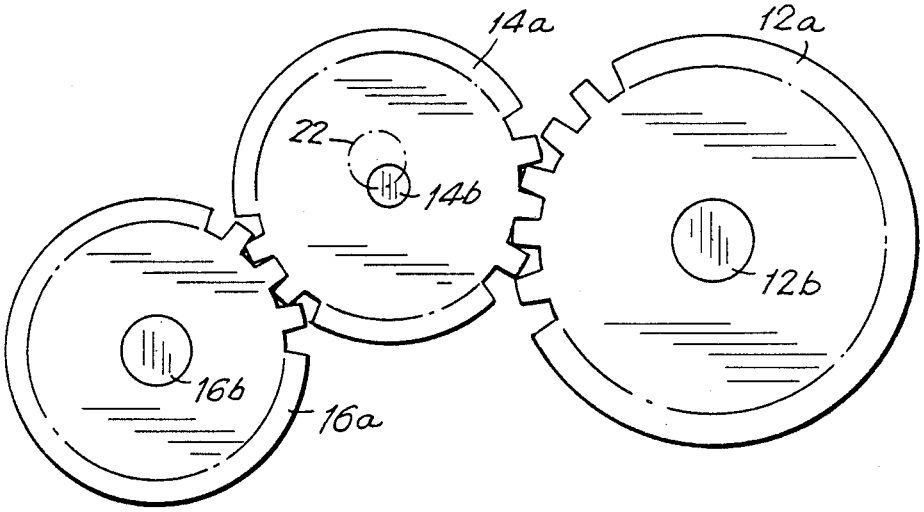
FIG. 3 is a diagrammatic illustration of the gear train of the present invention.

Referring now to the diagrammatic illustration of FIG. 3, the device of the present invention overcomes this problem in its entirety in an extremely simple and entirely satisfactory manner, as is now fully described in detail.

Referring now to FIG. 3, the respective gears 12*a*, 14*a* and 16*a* are each mounted on fixed and immovable axes, such that optimum meshing of the teeth of the respective gears is provided without regard to adjustments made in the position of the form roll 14 and the metering roll 16. Contrary to the proposals of the prior art, the form roll 14, instead of being mounted for rotation about an axis coincident with the axis of the idler gear 14*a*, is mounted for movement of its longitudinal axis in an orbital path 22 relative to the fixed axis 14*b* of the idler gear 14*a*. Similarly, and if desired, the metering roll 16 can be supported in an identical manner to the form roll 14 for movement of the longitudinal axis of the metering roll 16 in an orbital path about the fixed axis 16*b* of the driven gear 16*a*.

The manner in which this orbital movement of the axis of the form roll 14, and if required, that of the metering roll 16, can be accomplished will now be described with reference to FIGS. 4 and 5.

Figure 4:
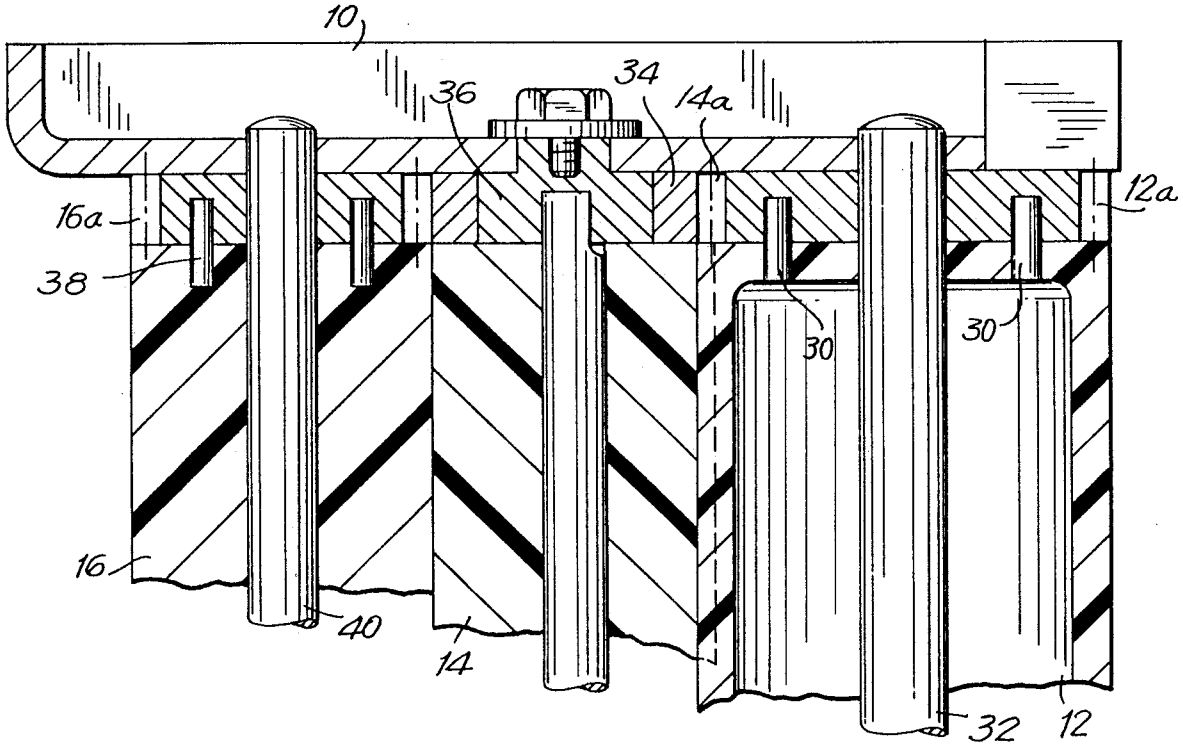
FIG. 4 is a fragmentary cross-section taken on the line 4—4 of FIG. 1.

Referring firstly to FIG. 4, one end of the respective printing cylinder and rolls is shown in association with one of the frame members 10. The printing cylinder 12 is illustrated as carrying a spur gear 12*a* which is pinned thereto at 30 for rotation in unison therewith. The spur gear 12*a* is driven from a main drive of the printing press in any convenient manner, thus causing rotation of the printing cylinder about the fixed shaft 32. The spur gear 12*a* in turn meshes with the teeth 14*a* of an idler gear 34 which is journaled for rotation on a fixed bearing 36. The teeth 14*a* of the idler gear 34 in turn mesh with the teeth 16*a* of the driven gear of the metering roll 16, which conveniently is pinned at 36 to the metering roll 16 for rotation in unison therewith, the metering roll 16 being journaled for rotation on a fixed shaft 38.

As has been previously explained, the form roll 14 is not mounted for rotation in unison with the idler gear 34. Instead, the form roll 14 is rotatable relative to the idler gear 34, and in addition, the axis of rotation of the form roll 14 is displaceable on an orbital path relative to the idler gear 34. Thus, without regard to the position of the form roll 14 and its longitudinal axis, each of the gears 12*a*, 14*a*, 16*a*, remain journaled about a fixed axis, the respective axes being immovable one relative to the other.

Figure 5:
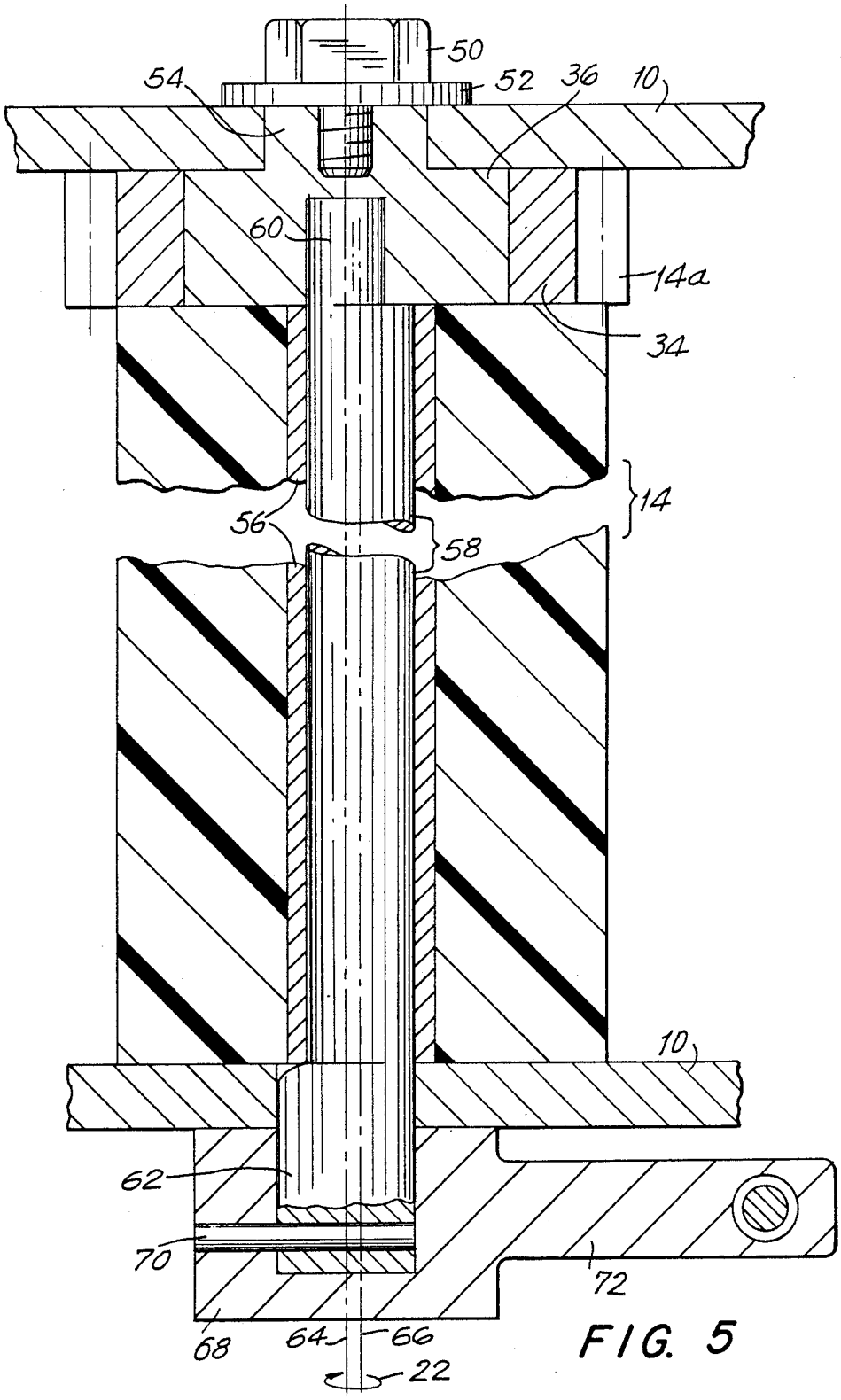
FIG. 5 is an enlarged transverse cross-section through the form roll, showing the manner of mounting the form roll according to the present invention.

Referring now to FIG. 5, which shows the mounting of the form roll 14 in enlarged detail, the form roll 14 is shown as extending between the opposed end frames 10, 10. The bearing 36 is fixedly held in one of the end frames 10, conveniently, by means of a threaded bolt 50 extending through a washer 52, the bolt 50 being threaded into an axial extension 54 of the bearing 36. The extension 54 can be cylindrical in cross-section, or of any other cross-sectional shape, the sole requirement being that the bearing 36 be immovable and that it provide a support for the idler gear 14*a*.

Extending within the form roll 14 is an anti-friction sleeve 56 which conveniently is a tubular sleeve of brass having a low coefficient of friction. The form roll itself is formed from a relatively hard resilient but compressible rubber or rubber like material, and conveniently can be formed from an elastomer.

Extending within the anti-friction sleeve 56 is a shaft 58 having an eccentric 60–62 at each of its opposite ends. While the eccentric 60 and 62 can be of different diameter, the essential condition is that the longitudinal axis of the respective eccentrics be coincident with each other along the central longitudinal axis 64. The longitudinal axis 66 of the shaft 58 is located in staggered relationship relative to the longitudinal axis 64. Thus, rotation of the shaft 58 and its associated eccentrics 60 and 62 will cause the longitudinal axis of the shaft 58 to move in an orbital path about the longitudinal axis of the eccentrics 60 and 62, i.e., to move in the orbital path described with reference to FIG. 3.

Any convenient means is provided for rotating the shaft 58 about the longitudinal axis 64. As illustrated, this can be accomplished by means of a handle 72 pinned to the eccentric 62 at 70. The handle 72 can be manually actuated, or, as will be well understood, it can be actuated under the control of a micrometer screw arrangement diagrammatically indicated at 74.

While the structure for adjusting the form roll 14 has been described with particular reference to FIG. 5, it will be appreciated that the metering roll 16 can be adjustably mounted in an identical manner to that described with reference to FIG. 5, in order to ensure correct meshing of the teeth of the respective gears 12*a*, 14*a* and 16*a*, without reference to the position of adjustment of either the form roll 14 or the metering roll 16.

As will be appreciated, various modifications may be made in the preferred embodiment described above without departing from the scope of the invention as defined by the appended claims. For example, the idler gear 14*a* could be journaled for rotation directly on the adjacent end frame 10, and, the eccentric 60 journaled for rotation directly in the associated end frame 10, this being in accordance with the specific requirement of the present invention that the idler gear 34 be mounted for rotation about a fixed axis, whereas the axis of rotation for the shaft 58 is adjustable on an orbitable path relative to that fixed axis.

I claim:

1. A water and ink dispensing device for a rotary printing press, said device comprising:

first and second spaced parallel shafts;

a third shaft spaced from and disposed between the first and second shafts, the third shaft being provided with a central section having a first axis and first and second opposite end sections, positioned on a common second axis spaced from the first axis, the first end section defining a first eccentric with respect to the central section, and the second end section defining a second and different eccentric with respect to the central section, the second axis being parallel to the first and second shafts;

a printing cylinder rotatable about the first shaft and having an external cylindrical surface;

a form roll rotatable about the central section of the third shaft and spaced from the opposite end sections thereof, the form roll having an external cylindrical surface frictionally engaging the surface of the printing cylinder;

a metering roll rotatable about the second shaft and having an external cylindrical surface frictionally engaging the surface of the form roll and spaced apart from the surface of the cylinder;

a spur gear secured to the cylinder and rotatable therewith about the first shaft;

a fixed support having an axial bore, the axis of the bore being coincident with the second axis, the first end section being disposed in the bore;

an idler gear rotatable about the fixed support and rotatably engaging the spur gear whereby the spur gear and idler gear rotate together;

a driven gear secured to the metering roll and rotatable therewith about the second shaft, the driven gear engaging the idler gear and rotated therewith; and means connected to the second end section to rotate the entire third shaft to move the central section thereof in an orbital path about the second axis, the form roller being rotated by frictional engagement with the metering roll and the cylinder, the axis of rotation of the form roller being displaced in an orbital path with respect to the second axis.

2. The device of claim 1, wherein the first and second end sections have diameters different from each other and from the diameter of the central section.

3. The device of claim 2, wherein said means includes a handle pinned to the second end section and additional means for rotating the handle.

4. The device of claim 3, further including first and second parallel spaced apart end members, one member supporting one corresponding end of each of the first and second shafts and providing said fixed support, the other member supporting the other corresponding end of each of the first and second shafts and having an opening through which the second end section extends.

5. The device of claim 4, wherein the second member has a surface adjacent the central section and an opposite surface remote from the central section, the means being disposed adjacent the opposite surface.

* * * * *